United States Patent [19]

Baltz

[11] Patent Number: 4,722,708

[45] Date of Patent: Feb. 2, 1988

[54] MARINE PROPULSION DEVICE FUEL DISTRIBUTION SYSTEM

[75] Inventor: Gene F. Baltz, Lake Villa, Ill.

[73] Assignee: Outboard Marine Corporation, Waukegan, Ill.

[21] Appl. No.: 727,814

[22] Filed: Apr. 26, 1985

[51] Int. Cl.[4] ..... B63H 21/38

[52] U.S. Cl. ..... 440/88; 114/211; 123/468; 123/514; 123/518; 440/113; 440/900

[58] Field of Search ..... 440/88, 900, 113, 76, 440/77, 84; 123/468, 469, 509, 514, 516, 518; 114/211

[56] References Cited

U.S. PATENT DOCUMENTS

| | | | |
|---|---|---|---|
| 741,512 | 10/1903 | Lee | 440/88 |
| 1,724,559 | 8/1929 | Butler | 440/88 |
| 3,031,010 | 4/1962 | Wise | 123/516 X |
| 3,645,244 | 2/1972 | Seyfarth | 123/518 |
| 3,696,799 | 10/1972 | Gauck | 123/518 |
| 3,957,025 | 5/1976 | Heath et al. | 123/518 |
| 3,977,379 | 8/1976 | Weissenbach | 123/518 |
| 4,136,652 | 1/1979 | Lee | 123/514 |
| 4,285,316 | 8/1981 | Stolz | 123/514 |
| 4,362,130 | 12/1982 | Robinson | 123/518 X |
| 4,371,348 | 2/1983 | Blanchard | 440/77 X |
| 4,416,638 | 11/1983 | Ellis | 440/88 |

FOREIGN PATENT DOCUMENTS

| | | | |
|---|---|---|---|
| 666124 | 7/1963 | Canada | 123/514 |
| 2509362 | 9/1975 | Fed. Rep. of Germany | 123/514 |
| 148958 | 11/1980 | Japan | 123/509 |
| 2083787 | 3/1982 | United Kingdom | 440/88 |

*Primary Examiner*—Joseph F. Peters, Jr.
*Assistant Examiner*—Paul E. Salmon
*Attorney, Agent, or Firm*—Michael, Best & Friedrich

[57] ABSTRACT

A marine propulsion installation for use on a boat having an exterior and an interior, the marine propulsion installation comprising an engine, and a rotatably mounted propeller driven by the engine, a source of fuel adapted to be located interiorly of the boat, a supply conduit communicating between the source of fuel and the engine, and a fuel impermeable housing conduit sealingly connected to the source of fuel and surrounding the portion of the supply conduit located interiorly of the boat.

24 Claims, 4 Drawing Figures

MARINE PROPULSION DEVICE FUEL DISTRIBUTION SYSTEM

BACKGROUND OF THE INVENTION

The invention relates to marine fuel distribution systems, and more particularly to marine fuel distribution systems including a fuel tank inside a boat, and means for supplying fuel from the fuel tank to the engine of a marine propulsion device mounted on the boat.

Present fuel distribution systems typically include a fuel pump mounted on and driven by the engine of the marine propulsion device, and a fuel supply line communicating between a fuel tank and the suction side of the fuel pump. Other components, such as an anti-siphon valve, a tank switching valve, and an in-line fuel filter, may be included on the suction side of the fuel pump. The fuel pump must create a negative pressure to draw fuel through the fuel distribution system, and this negative pressure can cause the fuel to vaporize in the fuel supply line. The result can be inability of the fuel distribution system to supply liquid fuel to the engine at a given fuel flow rate due to excessive fuel vapor generation, often referred to as vapor lock.

The only known method of preventing vapor lock is to pump the fuel under pressure through the fuel distribution system to the engine. Pumping the fuel under pressure will eliminate the tendency of the fuel to vaporize because it is at a positive pressure. However, leakage of a pressurized fuel line would allow fuel to leak into the bilge of a boat.

Attention is directed to Ellis U.S. Pat. No. 4,416,638, issued Nov. 22, 1983, which discloses a fuel distribution system including a casing surrounding the upstream portion of a gas feed pipe between the boat transom and the carburetor of the engine. The casing is not connected to the source of fuel and does not surround the entire portion of the fuel pipe located interiorly of the boat.

Attention is also directed to the following U.S. patents which disclose fuel distribution systems: Lee U.S. Pat. No. 741,512, issued Oct. 13, 1903, Butler U.S. Pat. No. 1,724,559, issued Aug. 13, 1929, Wise U.S. Pat. No. 3,031,010, issued Apr. 24, 1962, Gauck U.S. Pat. No. 3,696,799, issued Oct. 10, 1972, Heath U.S. Pat. No. 3,957,025, issued May 18, 1976, Weissenbach U.S. Pat. No. 3,977,379, issued Aug. 31, 1976, Lee U.S. Pat. No. 4,136,652, issued Jan. 30, 1979, Stolz U.S. Pat. No. 4,285,316, issued Aug. 25, 1981 and Robinson U.S. Pat. No. 4,362,130, issued Dec. 7, 1982.

SUMMARY OF THE INVENTION

The invention provides a marine propulsion installation for use on a boat having an exterior and an interior, the marine propulsion installation comprising an engine, and a rotatably mounted propeller driven by the engine, a source of fuel adapted to be located interiorly of the boat, supply conduit means communicating between the source of fuel and the engine and having a portion located interiorly of the boat, and fuel impermeable housing means sealingly connected to the source of fuel and surrounding the portion of the supply conduit means.

In one embodiment, the marine propulsion installation further comprises means for venting the housing means to the exterior of the boat.

In one embodiment, the engine is adapted to be mounted interiorly of the boat, and the means for venting the housing means includes conduit means communicating with the engine and with the housing means adjacent the engine for venting the housing means into the engine.

In one embodiment, the engine includes a vacuum source, and the means for venting the housing means includes conduit means communicating between the vacuum source and the housing means adjacent the engine.

In one embodiment, the venting means includes means communicating with the housing means adjacent the source of fuel for venting the housing means to the exterior of the boat.

In one embodiment, the boat includes a transom including an opening, the engine is adapted to be mounted exteriorly of the transom, the supply conduit extends through the opening in the transom to the engine, and the marine propulsion device further comprises means for sealing the housing means to the interior of the transom in communication with the opening in the transom and so as to prevent communication between the housing means and the interior of the boat.

In one embodiment, the source of fuel includes a fuel tank having an exterior and including a fuel chamber, and the housing means is sealingly connected to the exterior of the fuel tank so as to prevent communication between the housing means and the interior of the boat, and between the housing means and the fuel chamber.

In one embodiment, the source of fuel includes a fuel tank including a fuel chamber, and the source of fuel further includes a pump mounted in the fuel tank and communicating with the fuel chamber and with the supply conduit means.

In one embodiment, the marine propulsion device further comprises return conduit means communicating between the engine and the source of fuel and having a portion located interiorly of the boat, and the housing means also surrounds the portion of the return conduit means.

A principal feature of the invention is the provision of a marine propulsion device comprising an engine, a source of fuel adapted to be located interiorly of a boat, supply conduit means communicating between the source of fuel and the engine, and fuel impermeable housing means sealingly connected to the source of fuel and surrounding the portion of the supply conduit means located interiorly of the boat. This allows the fuel to be pumped under pressure from the source of fuel to the engine while substantially eliminating the possibility of the fuel leaking from the supply conduit means into the bilge of the boat.

Another principal feature of the invention is the provision of a marine propulsion device as described above and comprising an outboard motor pivotally mounted on the exterior of the transom of the boat, wherein the supply conduit extends from the source of fuel through an opening in the transom to the engine, and wherein the housing conduit is sealed to the interior of the transom in communication with the opening in the transom. Thus, the housing conduit surrounds the entire length of the supply conduit inside the boat and is vented to the atmosphere via the opening in the transom.

Another principal feature of the invention is the provision of a marine propulsion device as described above and comprising an inboard engine including an intake manifold, and conduit means communicating between the intake manifold and the housing conduit adjacent the engine. This allows venting of the housing conduit through the engine.

Other features and advantages of the invention will become apparent to those skilled in the art upon review of the following detailed description, claims, and drawings.

Figure 1:
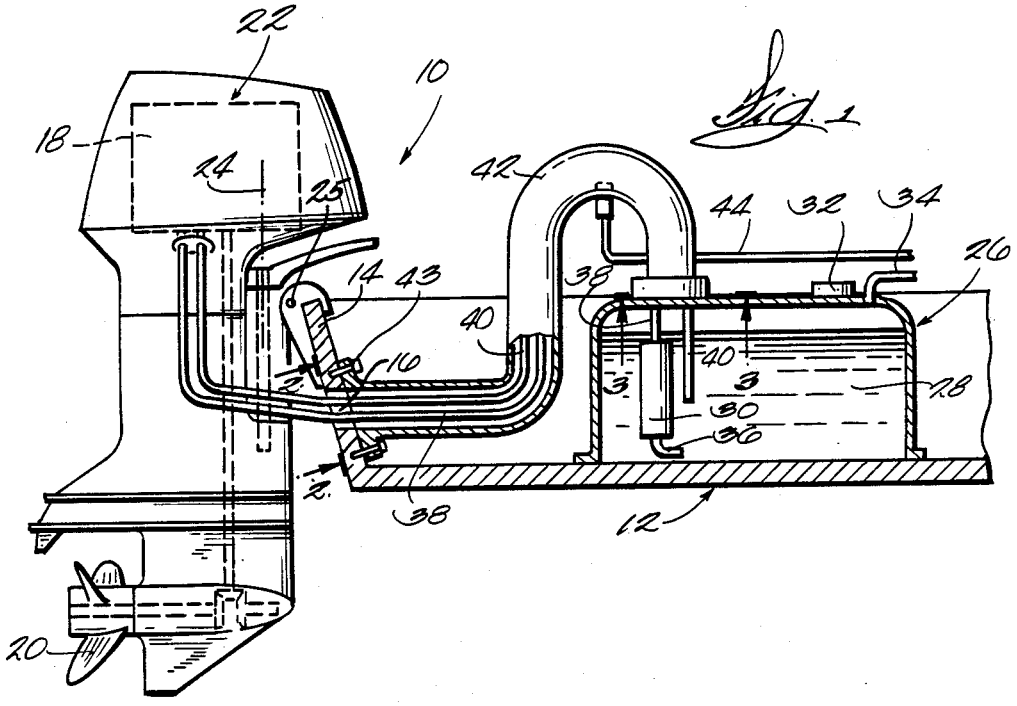
FIG. 1 is a side elevational view, partially in cross-section, of a marine propulsion installation embodying the invention.
Figure 2:
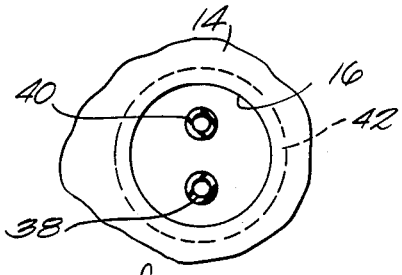
FIG. 2 is a cross-sectional view taken along line 2—2 in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

FIG. 1 is a partially schematic view of a marine propulsion installation 10 embodying the invention. The installation 10 comprises a boat 12 having an interior, an exterior, and a transom 14 having an opening 16 therein. The installation 10 also comprises a marine propulsion device including an engine 18, and a rotatably mounted propeller 20 driven by the engine 18. In the preferred embodiment, as shown in FIG. 1, the marine propulsion device is an outboard motor 22 pivotally mounted on the exterior of the transom 14 for pivotal movement relative to the transom 14 about a generally vertical steering axis 24, and about a generally horizontal tilt axis 25.

Figure 4:
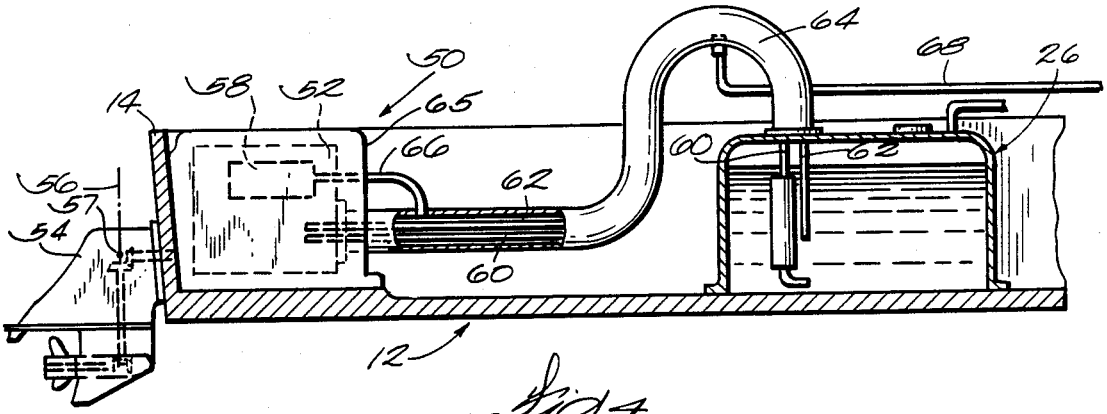
FIG. 4 is a side elevational view similar to FIG. 1 of an alternative embodiment of the invention.

In an alternative embodiment which is illustrated in FIG. 4, the marine propulsion device is a stern drive or inboard/outboard unit. In another alternative embodiment, the marine propulsion device can include an engine which is located within the boat and which drives a propeller supported for rotation about an axis fixed with respect to the boat.

The marine propulsion installation 10 also comprises a source of fuel located interiorly of the boat 12. Preferably, the source of fuel includes a conventional fuel tank 26 having an exterior and including a fuel chamber 28, and a pump 30 mounted interiorly of the fuel tank 26 within the fuel chamber 28. The fuel tank 26 also includes a removable fill cap 32, and a conduit 34 venting the fuel chamber 28 to the exterior of the boat 12. While other constructions can be used, in the illustrated construction, the pump 30 is a submersible electric pump equipped with a fuel filter 36 which reaches to the bottom of the fuel chamber 28.

The marine propulsion installation 10 also comprises supply conduit means communicating between the fuel tank 26 and the engine 18 and having a portion located interiorly of the boat 12. In the preferred embodiment, the supply conduit means includes a flexible supply conduit 38 extending through the opening 16 in the transom 14 and communicating between the pump 30 and the engine 18. The pump 30 delivers fuel under pressure through the supply conduit 38 to the engine 18.

In the preferred embodiment, the marine propulsion installation 10 further comprises return conduit means communicating between the engine 18 and the fuel chamber 28 of the fuel tank 26 and having a portion located interiorly of the boat 12. The return conduit means returns fuel not consumed by the engine 18 to the fuel chamber 28. Preferably, the return conduit means includes a flexible return conduit 40 communicating between the engine 18 and the fuel chamber 28.

Figure 3:
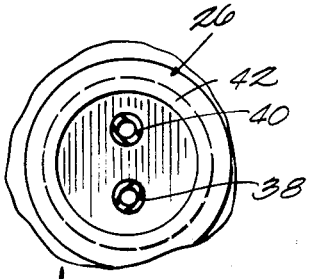
FIG. 3 is a cross-sectional view taken along line 3—3 in FIG. 1.

The marine propulsion installation 10 further comprises fuel impermeable housing means sealingly connected to the exterior of the fuel tank 26 and surrounding the portions of the supply and return conduits 38 and 40 located interiorly of the boat 12. In the preferred embodiment, the housing means is a housing conduit 42 that is sealingly connected to the exterior of the fuel tank 26 so as to prevent communication between the housing conduit 42 and the interior of the boat 12, and between the housing conduit 42 and the fuel chamber 28. The connection of the housing conduit 42 to the fuel tank 26 is best shown in FIG. 3. The end of the housing conduit 42 is closed, except for two openings through which the supply and return conduits 38 and 40 extend, and only the supply and return conduits 38 and 40 communicate with the fuel chamber 28. The housing conduit 42 surrounds the portions of the supply and return conduits 38 and 40 extending between the fuel tank 26 and the transom 14.

In the preferred embodiment, the marine propulsion installation 10 further comprises means for sealingly connecting the housing conduit 42 to the interior of the transom 14 in communciation with the opening 16 in the transom 14 and so as to prevent communication between the housing conduit 42 and interior of the boat 12. In the construction shown in FIG. 1, the aft end of the housing conduit 42 includes an annular flange, and the sealing means includes screws 43 securing the flange to the transom 14. Thus, the ends of the housing conduit 42 are sealingly connected to the fuel tank 26 and to the interior of the transom 14, so that any fuel leaking into the housing conduit 42 cannot leak into the interior of the boat 12.

In the preferred embodiment, the marine propulsion installation 10 further comprises means for venting the housing conduit 42 to the exterior of the boat 12. In the illustrated construction, the venting means includes the means connecting the housing conduit 42 to the transom 14 so that the interior of the housing conduit 42 is vented to the exterior of the boat 12 via the opening 16 in the transom 14. Preferably, the venting means also includes means communicating with the housing conduit 14 adjacent the fuel tank 26 for venting the housing conduit 42 to the exterior of the boat 12. In the illustrated construction, this means includes a venting conduit 44 having one end communicating with the housing conduit 42 and an opposite end communicating with the atmosphere exteriorly of the boat 12.

With the housing conduit 42 being vented at one end by the venting conduit 44 and at the other end through the opening 16 in the transom 14, constant air flow through the housing conduit 42 is permitted. This facilitates the removal of fuel vapors collecting in the housing conduit 42.

FIG. 4 is a partially schematic view of a marine propulsion installation that is an alternative embodiment of the invention. The installation comprises a marine propulsion device 50 which is a stern drive or inboard/outboard unit including an engine 52 mounted inside the boat 12, and a propulsion unit 54 mounted on the exterior of the transom 14 for pivotal movement relative to the transom 14 about a generally vertical steering axis 56, and about a generally horizontal tilt axis 57. The engine 52 includes a vacuum source, preferably an intake manifold 58.

The installation also comprises supply and return conduits 60 and 62 communicating between the engine 52 and the fuel tank 26, and a housing conduit 64 sealingly connected to the exterior of the fuel tank 26 and surrounding the supply conduit 60 and the return conduit 62. In this embodiment, the portions of the supply and return conduits 60 and 62 located interiorly of the boat 12 are the entire conduits. The housing conduit 64 is sealingly connected to the exterior of the fuel tank 26 as in the preferred embodiment, and is similarly sealingly connected to the engine 52. In the illustrated construction, the housing conduit 64 extends inside the engine compartment 65 and is sealingly connected to the engine 52 so as to prevent fuel from leaking into the engine compartment 65.

The installation further comprises means for venting the housing conduit 64 to the exterior of the boat 12. In the illustrated construction, the venting means includes conduit means 66 communicating between the intake manifold 58 and the housing conduit 64 adjacent the engine 52. Preferably, the venting means also includes a venting conduit 68 having one end communicating with the housing conduit 64 adjacent the fuel tank 26, and an opposite end communicating with the atmosphere exteriorly of the boat 12. With the housing conduit 64 being vented at one end into the intake manifold 58 and at the other end by the venting conduit 68, constant air flow through the housing conduit 64 is established. Fuel vapors collecting inside the housing conduit 64 are sucked into the intake manifold 58 via the conduit means 66 and are exhausted through the engine 52.

Various other features and advantages of the invention are set forth in the following claims.

I claim:

1. A marine propulsion installation adapted for use on a boat having a transom including an opening, said marine propulsion installation comprising a propulsion unit adapted to be mounted exteriorly of the transom and including an engine, and a rotatably mounted propeller driven by said engine, a source of fuel adapted to be located interiorly of the boat, fuel supply conduit means communicating between said source of fuel and said engine and having a portion located interiorly of the boat and adapted to extend through the transom to said engine, fuel impermeable housing means sealingly connected to said source of fuel and including an interior receiving said portion of said supply conduit means, means adapted for sealingly connecting said housing means to the transom with said interior of said housing means in communication with the transom opening and so as to prevent communication between said interior of said housing means and the interior of the boat, and means communicating with said interior of said housing means for venting said interior of said housing means to exterior of the boat.

2. A marine propulsion installation as set forth in claim 1 wherein said venting means includes means communicating with said interior of said housing means adjacent said source of fuel for venting said interior of said housing means to the exterior of the boat.

3. A marine propulsion installation as set forth in claim 1 wherein said source of fuel includes a fuel tank having an exterior and including a fuel chamber, and wherein said housing means is sealingly connected to said exterior of said fuel tank so as to prevent communication between said interior of said housing means and the interior of the boat, and between said interior of said housing means and said fuel chamber.

4. A marine propulsion installation as set forth in claim 1 wherein said source of fuel includes a fuel tank including a fuel chamber, and wherein said source of fuel further includes a pump mounted on said fuel tank and communicating with said fuel chamber and with said supply conduit means.

5. A marine propulsion installation as set forth in claim 1 and further comprising return conduit means communicating between said engine and said source of fuel and having a portion located interiorly of the boat, and wherein said housing means also surrounds said portion of said return conduit means.

6. A marine propulsion installation adapted for use on a boat having a transom, said marine propulsion installation comprising an engine adapted to be mounted interiorly of the boat, a propulsion unit adapted to be mounted on the boat exteriorly of the transom and including a rotatably mounted propeller driven by said engine, a source of fuel adapted to be located interiorly of the boat, fuel supply conduit means adapted to extend interiorly of the boat and communicating between said source of fuel and said engine, fuel impermeable housing means sealingly connected to said source of fuel and to said engine and including an interior receiving said fuel supply conduit means, and, means for venting said interior of said housing means including a conduit communicating with said interior of said housing means adjacent said engine and with said engine for venting said interior of said housing means into said engine.

7. A marine propulsion installation as set forth in claim 6 wherein said engine includes a vacuum source, and wherein said means for venting said interior of said housing means includes conduit means communicating between said vacuum source and said interior of said housing means adjacent said engine.

8. A marine propulsion installation as set forth in claim 6 wherein said venting means includes means communicating with said interior of said housing means adjacent said source of fuel for venting said interior of said housing means to the exterior of the boat.

9. A marine propulsion installation as set forth in claim 6 wherein said source of fuel includes a fuel tank having an exterior and including an interior fuel chamber, and wherein said housing means is sealingly connected to said exterior of said fuel tank so as to prevent communication between said interior of said housing means and the interior of the boat, and between said interior of said housing means and said fuel chamber.

10. A marine propulsion installation as set forth in claim 6 wherein said source of fuel includes a fuel tank including a fuel chamber, and wherein said source of fuel further includes a pump mounted on said fuel tank and communicating with said fuel chamber and with said supply conduit means.

11. A marine propulsion installation as set forth in claim 6 and further comprising return conduit means communicating between said engine and said source of fuel, and wherein said housing means also surrounds said return conduit.

12. A marine propulsion installation adapted for use on a boat having an interior, an exterior, and a transom including an opening therein, said marine propulsion installation comprising a propulsion unit including a rotably mounted propeller, and an engine drivingly connected to said propeller, said propulsion unit being adapted to be pivotally mounted on the exterior of the transom for pivotal movement relative to the transom, a source of fuel adapted to be located interiorly of the boat, said source of fuel including a fuel tank having an exterior and including a fuel chamber, and a pump mounted interiorly of said fuel tank and communicating with said fuel chamber, a supply conduit adapted to extend through the opening in the transom and communicating between said pump and said engine, a return conduit adapted to extend through the opening in the transom and communicating between said fuel chamber and said engine, a fuel impermeable housing conduit including an interior receiving said supply conduit and said return conduit between said fuel tank and the opening in the transon, being sealingly connected to said exterior of said fuel tank so as to prevent communication between said interior of said housing conduit and the interior of the boat, and between said interior of said housing conduit and said fuel chamber, means for sealing said housing conduit to the interior of the transom and with said interior of said housing conduit in communication with the opening in the transom and so as to prevent communication between said interior of said housing conduit and the interior of the boat, and means communicating with said interior of said housing conduit adjacent said fuel tank for venting said interior of said housing conduit to the exterior of the boat.

13. A marine propulsion installation adapted for use on a boat having an interior, an exterior, and a transom, said marine propulsion installation comprising an engine adapted to be mounted interiorly of the boat and including a vacuum source, and a propulsion unit adapted to be pivotally mounted on the exterior of the transom for pivotal movement relative to the transom and including a rotably mounted propeller driven by said engine, a source of fuel adapted to be located interiorly of the boat, said source of fuel including a fuel tank having an exterior and including a fuel chamber, and a pump mounted interiorly of said fuel tank and communicating with said fuel chamber, a supply conduit communicating between said pump and said engine, a return conduit communicating between said fuel chamber and said engine, a fuel impermeable housing conduit including an interior receiving said supply conduit and said return conduit between said fuel tank and said engine, and being sealingly connected to said exterior of said fuel tank so as to prevent communication between said interior of said housing conduit and the interior of the boat, and between said interior of said housing conduit and said fuel chamber, means communicating with said interior of said housing conduit adjacent said fuel tank for venting said interior of said housing conduit to the exterior of the boat, and conduit means communicating between said vacuum source and said interior of said housing conduit adjacent said engine.

14. A marine propulsion apparatus adapted for use on a boat having an interior and a transom, said marine propulsion device comprising an engine adapted to be mounted interiorly of the boat, a drive unit adapted to be pivotally mounted on the boat exteriorly of the transom for pivotal movement relative to the transom about a generally vertical steering axis and including a rotatably mounted propeller driven by said engine, a fuel tank adapted to be located interiorly of the boat and having an exterior and including an interior fuel chamber, a fuel conduit communicating between said fuel chamber and said engine and adapted to be wholly located interiorly of the boat, a fuel impermeable housing conduit having an interior receiving said fuel conduit between said fuel tank and said engine and sealingly connected to said fuel tank exterior so as to prevent communication between said interior of said housing conduit and each of said fuel chamber and the boat interior and sealingly connected to said engine so as to prevent communication between said interior of said housing conduit and the boat interior, and means communicating with said interior of said housing conduit for venting said interior of said housing conduit.

15. A marine propulsion apparatus in accordance with claim 14 wherein said means for venting said interior of said housing conduit comprises a vent conduit communicating with said interior of said housing conduit adjacent said fuel tank and adapted to communicate with the atmosphere exteriorly of the boat.

16. A marine propulsion apparatus in accordance with claim 14 wherein said means for venting said interior of said housing conduit comprises a conduit extending between said interior of said housing conduit and said engine.

17. A marine propulsion apparatus in accordance with claim 14 wherein said means for venting said interior of said housing conduit comprises a vent conduit communicating with said interior of said housing conduit adjacent said fuel tank and adapted to communicate with the atmosphere exteriorly of the boat, and a conduit extending between said interior of said housing conduit and said engine.

18. A marine propulsion installation including a boat having an interior and a transom, an engine mounted interiorly of said boat, a drive unit pivotally mounted on said boat exteriorly of said transom for pivotal movement relative to said transom about a generally vertical steering axis and including a rotatably mounted propeller driven by said engine, a fuel tank located interiorly of said boat and having an exterior and including an interior fuel chamber, a fuel conduit communicating between said fuel chamber and said engine and wholly located interiorly of said boat, a fuel impermeable housing conduit having an interior receiving said fuel conduit between said fuel tank and said engine and sealingly connected to said fuel tank exterior so as to prevent communication between said interior of said housing conduit and each of said fuel chamber and said boat interior and sealingly connected to said engine so as to prevent communication between said interior of said housing conduit and said boat interior, and means communicating with said interior of said housing conduit for venting said interior of said housing conduit.

19. A marine propulsion installation in accordance with claim 18 wherein said means for venting said interior of said housing conduit comprises a vent conduit communicating with said interior of said housing conduit adjacent said fuel tank and with the atmosphere exteriorly of the boat.

20. A marine propulsion installation in accordance with claim 18 wherein said means for venting said interior of said housing conduit comprises a conduit extending between said interior of said housing conduit and said engine.

21. A marine propulsion installation in accordance with claim 18 wherein said means for venting said interior of said housing conduit comprises a vent conduit communicating with said interior of said housing conduit adjacent said fuel tank and with the atmosphere exteriorly of the boat, and a conduit extending between said interior of said housing conduit and said engine.

22. A marine propulsion apparatus adapted for use on a boat having an interior and a transom including therein an opening, said marine propulsion apparatus comprising a propulsion unit adapted to be pivotally mounted on the boat exteriorly of the transom for pivotal movement relative to the transom about a generally vertical steering axis and including a rotatably mounted propeller, and an engine drivingly connected to said propeller, a fuel tank adapted to be located interiorly of the boat and having an exterior and including an interior fuel chamber, a fuel conduit communicating between said fuel chamber and said engine and adapted to extend through the opening in the transom, a fuel impermeably housing conduit including an interior receiving said fuel conduit between said fuel tank and the transom opening and sealingly connected to said fuel tank exterior so as to prevent communication between said interior of said housing conduit and each of said fuel chamber and the boat interior and adapted to be sealingly connected to the transom with said interior of said housing conduit in communication with the transom opening and so as to prevent communication between said interior of said housing conduit and the boat interior, and means communicating with said interior of said housing conduit adjacent said fuel tank for venting said housing conduit to the boat exterior.

23. A marine propulsion installation comprising a boat having an interior and a transom including therein an opening, a propulsion unit pivotally mounted on said boat exteriorly of said transom for pivotal movement relative to said transom about a generally vertical steering axis and including a rotatably mounted propeller, and an engine drivingly connected to said propeller, a fuel tank located interiorly of said boat and having an exterior and including an interior fuel chamber, a fuel conduit communicating between said fuel chamber and said engine and extending through said transom opening, a fuel impermeable housing conduit having an interior receiving said fuel conduit between said fuel tank and said transom opening and sealingly connected to said fuel tank exterior so as to prevent communication between said interior of said housing conduit and each of said fuel chamber and said boat interior and sealingly connected to said transom in communication with said transom opening and so as to prevent communication betwen said interior of said housing conduit and said boat interior, and means communicating with said interior of said housing conduit adjacent said fuel tank for venting said interior of said housing conduit to exteriorly of said boat.

24. A marine propulsion installation including a boat having a transom including an opening, a propulsion unit mounted exteriorly of said transom and including an engine, and a rotatably mounted propeller driven by said engine, a source of fuel located interiorly of said boat, fuel supply conduit means communicating between said source of fuel and said engine and having a portion located interiorly of said boat and extending through said transom to said engine, fuel impermeable housing means sealingly connected to said source of fuel and including an interior receiving said portion of said supply conduit means, means sealingly connecting said housing means to said transom with said interior of said housing means in communication with said transom opening and so as to prevent communication between said interior of said housing means and the interior of said boat, and means communicating with said interior of said housing means for venting said interior of said housing means to exterior of said boat.

* * * * *